US011616320B2

(12) United States Patent
Storione et al.

(10) Patent No.: US 11,616,320 B2
(45) **Date of Patent: *Mar. 28, 2023**

(54) MULTIPOLAR CONNECTOR

(71) Applicant: CONEXTIVITY GROUP SA, Saint-Prex (CH)

(72) Inventors: Savino Storione, Saint-Prex (CH); Nicolas Convert, Saint-Prex (CH); Jean-Marie Buchilly, Saint-Prex (CH)

(73) Assignee: CONEXTIVITY GROUP SA, Saint-Prex (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/738,036

(22) Filed: May 6, 2022

(65) Prior Publication Data

US 2022/0263265 A1 Aug. 18, 2022

Related U.S. Application Data

(63) Continuation of application No. 17/045,385, filed as application No. PCT/IB2019/052818 on Apr. 5, 2019, now Pat. No. 11,374,351.

(30) Foreign Application Priority Data

Apr. 6, 2018 (WO) ..... PCT/IB2018/052390

(51) Int. Cl.
*H01R 13/52* (2006.01)
*H01R 12/71* (2011.01)
(Continued)

(52) U.S. Cl.
CPC ..... *H01R 13/521* (2013.01); *H01R 12/714* (2013.01); *H01R 13/2407* (2013.01); *H01R 13/502* (2013.01)

(58) Field of Classification Search
CPC ..... H01R 13/521; H01R 13/2407; H01R 13/502; H01R 12/714
See application file for complete search history.

(56) References Cited

U.S. PATENT DOCUMENTS 2,824,290 A 2/1958 Archer et al.
2,892,991 A 6/1959 Beebee et al.
(Continued)

FOREIGN PATENT DOCUMENTS

CN 102299438 12/2011
CN 104170184 11/2014
(Continued)

OTHER PUBLICATIONS

International Search Report dated Jun. 4, 2019, for application PCT/IB2019/052818.
(Continued)

*Primary Examiner* — Abdullah A Riyami
*Assistant Examiner* — Nader J Alhawamdeh
(74) *Attorney, Agent, or Firm* — Nixon & Vanderhye P.C.

(57) ABSTRACT

Connector comprising a substantially cylindrical base and a plug connectable to the base in a detachable manner, in which connector a plurality of contacts are mounted in a contact block. The block comprises a flexible membrane through which the contacts extend, the compression of the membrane allowing the sealing at the interface between said membrane and the contacts to be ensured.

20 Claims, 5 Drawing Sheets

(51) Int. Cl.
*H01R 13/24* (2006.01)
*H01R 13/502* (2006.01)

(56) References Cited

U.S. PATENT DOCUMENTS 3,112,975 A 12/1963 Hamel
3,237,147 A 2/1966 Elliott et al.
3,521,216 A 7/1970 Tolegian
4,601,528 A 7/1986 Spier
5,114,361 A 5/1992 Houtteman
5,413,508 A 5/1995 Obara
5,509,821 A 4/1996 Small et al.
5,554,042 A 9/1996 Denninger
5,704,792 A 1/1998 Sobhani
5,803,750 A 9/1998 Purington et al.
5,865,638 A 2/1999 Trafton
6,243,870 B1 6/2001 Graber
6,331,117 B1 12/2001 Brundage
6,395,985 B1 5/2002 Djeddah
6,422,903 B1 7/2002 Fekonja et al.
6,716,048 B2 4/2004 Collin et al.
6,719,578 B1 4/2004 Klassen et al.
6,895,261 B1 5/2005 Palamides
6,945,805 B1 9/2005 Bollinger
7,151,455 B2 12/2006 Lindsay et al.
7,462,035 B2 12/2008 Lee et al.
7,658,612 B2 2/2010 Lee et al.
8,490,525 B2 7/2013 Wilson et al.
8,496,494 B2 * 7/2013 Jordan ..... H01R 13/6277 439/680
8,961,191 B2 2/2015 Hanshew
9,054,445 B2 6/2015 O'Sullivan et al.
9,300,083 B2 3/2016 Bosscher et al.
9,502,822 B1 11/2016 Huang
9,847,609 B2 12/2017 Planard-Luong
10,574,006 B2 * 2/2020 Storione ..... H01R 35/04
2001/0018277 A1 8/2001 Gerard et al.
2001/0034152 A1 10/2001 Harris
2002/0003931 A1 1/2002 Cairns et al.
2002/0019177 A1 2/2002 Bartholomew
2002/0168889 A1 11/2002 Adduci
2003/0027435 A1 2/2003 Schneider et al.
2003/0057698 A1 3/2003 Parrott et al.
2003/0162431 A1 8/2003 Schmidt et al.
2004/0038596 A1 * 2/2004 Bartholoma ..... H01R 13/426 439/752
2004/0166740 A1 8/2004 Jorgensen
2005/0148241 A1 7/2005 Kohen
2006/0051999 A1 3/2006 Allemann et al.
2006/0110977 A1 5/2006 Matthews
2006/0128169 A1 6/2006 Marmaropoulos et al.
2007/0026695 A1 2/2007 Lee et al.
2007/0085023 A1 4/2007 Debroche et al.
2007/0087612 A1 4/2007 Tsujita
2007/0244422 A1 10/2007 Chiodo
2008/0214040 A1 9/2008 Holterhoff et al.
2008/0233785 A1 9/2008 Yaworski et al.
2009/0149086 A1 6/2009 Dahms
2009/0280673 A1 11/2009 Kohen
2009/0291579 A1 11/2009 Farole et al.
2010/0075512 A1 3/2010 Lai
2010/0100997 A1 4/2010 Lee et al.
2010/0259293 A1 10/2010 Seifried
2010/0291802 A1 11/2010 Sawai et al.
2011/0021049 A1 1/2011 Ramasubramanian et al.
2011/0098601 A1 4/2011 Huynh et al.
2012/0028489 A1 2/2012 Gramsamer et al.
2012/0052721 A1 3/2012 Watson
2012/0089002 A1 4/2012 Mackie
2012/0319398 A1 12/2012 Schweizer et al.
2013/0102182 A1 4/2013 Ijima
2013/0183866 A1 7/2013 Poulain et al.
2013/0288501 A1 10/2013 Russell et al.
2013/0344724 A1 12/2013 Song et al.
2014/0073176 A1 3/2014 Plant et al.
2014/0106589 A1 4/2014 Genta et al.
2014/0130329 A1 5/2014 Changsrivong et al.
2014/0134871 A1 5/2014 Jozwik et al.
2014/0179148 A1 6/2014 Huang
2014/0199896 A1 * 7/2014 Jordan ..... H01R 13/514 439/855
2014/0273543 A1 9/2014 Hanshew
2015/0093921 A1 4/2015 Lewin
2015/0093931 A1 4/2015 Burrow et al.
2015/0162674 A1 6/2015 Nishikawa et al.
2015/0325943 A1 11/2015 Frey et al.
2015/0340805 A1 * 11/2015 Jordan ..... H01R 13/622 439/338
2016/0056585 A1 2/2016 Dunwoody et al.
2016/0099527 A1 4/2016 Loveless et al.
2016/0211627 A1 7/2016 Planard-Luong
2016/0380380 A1 12/2016 Koepsell
2017/0104280 A1 4/2017 Edmonds et al.
2017/0141507 A1 5/2017 Tucker
2017/0264049 A1 9/2017 Tiberghien et al.
2017/0331207 A1 11/2017 Lappoehn
2018/0054017 A1 2/2018 Watkins et al.
2018/0069342 A1 3/2018 Kasar et al.
2018/0138685 A1 5/2018 Sandell et al.
2018/0212359 A1 * 7/2018 Wei ..... H05K 1/181
2018/0223888 A1 8/2018 Nguyen
2018/0323556 A1 * 11/2018 Storione ..... H01R 13/5219
2019/0067859 A1 2/2019 Sigiura
2019/0360847 A1 11/2019 Tanner et al.
2021/0159633 A1 * 5/2021 Storione ..... H01R 12/714
2021/0159640 A1 5/2021 Storione et al.

FOREIGN PATENT DOCUMENTS

CN 106299871 A 1/2017
CN 205911563 1/2017
CN 106877088 6/2017
CN 106998009 8/2017
CN 206619765 11/2017
DE 3722196 1/1989
DE 4135679 5/1993
EP 0021864 1/1981
EP 1843440 10/2007
EP 1988607 11/2008
EP 2144336 1/2010
EP 2461429 6/2012
EP 2533374 12/2012
EP 2806508 A1 11/2014
FR 1354923 3/1964
FR 2456406 12/1980
FR 2690569 10/1993
FR 2930683 10/2009
FR 3010245 3/2015
JP H02-052287 4/1990
KR 20130039691 A 4/2013
KR 101795298 11/2017
RU 2261505 C1 9/2005
RU 148877 U1 12/2014
SU 1693670 11/1991
WO WO 1997002630 1/1997
WO WO 2005053100 6/2005
WO WO 2006/060772 6/2006
WO WO 2011118917 9/2011
WO WO 2012112580 8/2012
WO WO 2013175720 11/2013
WO WO 2015028953 3/2015
WO WO 2017030573 2/2017
WO WO 2017072620 A1 5/2017
WO WO 2017159155 A1 9/2017

OTHER PUBLICATIONS

Office Action dated Apr. 8, 2022, issued in Russian Federation Patent Application No. 2020134236/07(062844), 6 pages.
Search Report dated Apr. 7, 2022, issued in Russian Federation Patent Application No. 2020134236/07(062844), 2 pages.

(56) References Cited

OTHER PUBLICATIONS

Written Opinion of the ISA dated Jun. 4, 2019, for application PCT/IB2019/052818.

* cited by examiner

MULTIPOLAR CONNECTOR

CROSS REFERENCE TO RELATED APPLICATIONS

The present application is a continuation (CONT) application of application Ser. No. 17/045,385, now U.S. Pat. No. 11,374,351, that was filed on Oct. 5, 2020, which in turn is a United States national stage patent application of International patent application with the Serial No. PCT/IB2019/052818 filed on Apr. 5, 2019 that designated the United States, and claims foreign priority to International patent application with the Serial No. PCT/IB2018/052390, filed on Apr. 6, 2018, the content of these earlier applications being incorporated by reference in their entirety in the present patent application.

FIELD OF THE INVENTION

The present invention relates to connectors, in particular multipolar electric connectors, that are used, for example, in the field of electric wiring. For example, the connectors in question are used for/in fields of application requiring both reliability and flexibility, such as applications of the wearable type, for example clothing or equipment for people moving in difficult environments (workers, emergency services, soldiers and security forces, etc.) or any other similar use.

PRIOR ART

In most cases, the use of a multipolar connector requires having the two main components of the connector (for example, a component containing male contacts, for example, a plug, and a component with female contacts, for example, a socket) connected together following a specific and predetermined angular orientation. This constraint may be achieved using particular shapes of the components allowing a connection according to a predetermined relative position, or by other equivalent technical means (such as asymmetrical constructions, interlocking elements, etc.).

However, having to align one component with respect to the other one before connecting them is inconvenient for the user. This inconvenience is particularly notable if the components of the connector cannot be seen by the user when the connection is made (for example due to a lack of light or in a position hidden from view), or when the connection must be made quickly.

There is therefore a need to be able to overcome this inconvenience.

International application WO 2017/072620 discloses a multipolar connector aiming to overcome these problems, the content of this previous application being incorporated by reference in the present application.

The connector described in this previous application comprises a substantially cylindrical shaped socket and a plug, which may be removably or detachably connected to the socket, with a plurality of contacts being disposed in said plug. The socket comprises a disc-shaped conductive face, on or in which at least one conductive track is disposed forming at least one arc of a circle, the center of which substantially coincides with the center of the conductive face, said track also being disposed so as to form a mechanical-electrical coupling with one of said contacts of the plug when the plug and the socket are connected.

In the particular configuration that comprises only one circular track, the center of the surface of the socket is a conductor disc, which is disposed so as to form an electric coupling with a contact of the plug disposed at the center thereof.

Preferably, the disclosed connector comprises several circular conductive tracks, which are disposed concentrically. In general, the number of tracks is equal to the number of contacts, but in embodiments, their number may differ. This construction and its various embodiments are applicable to the connector according to the present invention.

GENERAL DESCRIPTION OF THE INVENTION

The present invention aims to offer improvements to the known connectors, and in particular to the connector disclosed in WO 2017/072620, notably with respect to the fluid-tightness of said connector in order to allow its use in unfavorable environments (damp, dusty, etc.), among others things.

One embodiment of the present invention relates to a contact block 1 acting as a connector or being able to be reversibly (detachable) integrated in a connector in order to transmit any electric signal through the connector.

This block is highly sealed and allows the function of transmitting the signal to be guaranteed in unfavourable environments, for example, with pressurized fluids (such as water), dust, ice, etc.

More specifically, in one embodiment, the invention relates to a contact block for a connector, the block comprising at least one flexible membrane traversed by contacts, wherein said flexible membrane allows the seal to be provided at the interface between said membrane and the contacts.

In a particular embodiment, the compression of the membrane allows this seal to be provided at the interface between said membrane and the contacts through the deformation of the membrane during compression.

In another embodiment, the aim is to obtain the adhesion of the membrane and of the contacts by a bond of the physicochemical type, for example, a gluing or other equivalent means, such as surface treatments.

In embodiments, the electric contacts have a degree of freedom allowing them to both exert a force on a part of the connector acting as a counter-part and positioned opposite the block, as well as to have independence of movement with each other. The counter-part may be the socket of a connector, for example.

In embodiments, the contacts are of the "piston contact" type, for example.

In embodiments, the block is connected to a PCB or to other equivalent connection means.

In embodiments, each contact of the block is axially freely mounted, preferably independently of the other contacts.

In embodiments, the contacts may or may not be distributed asymmetrically.

In embodiments, the invention relates to a plug or a socket for a connector comprising at least one block as disclosed in the present application.

In embodiments, the plug may or may not be angled.

In embodiments, the invention relates to a connector comprising at least one block and/or one plug or socket as disclosed in the present application.

In embodiments, the connector may comprise a socket, on which the plug is connected.

In embodiments, the plug may be connected such that it rotates freely around the socket.

In embodiments, the plug may be connected according a limited number of orientations about the socket.

In embodiments, the block comprises a plurality of contacts and the socket comprises a plurality of conductive tracks. The tracks are preferably of circular shape and are disposed concentrically.

In embodiments, the number of tracks of the socket is equal to the number of contacts of the plug. In embodiments, their number may be different.

In embodiments, the contacts may be on the socket and the tracks may be on the plug.

In embodiments, the connector according to the invention comprises a locking system allowing the rotation of the plug to be blocked relative to the socket and/or said rotation to be limited and/or the unplugging of the plug on the socket to be blocked, for example, below a certain traction force threshold.

In embodiments, the invention relates to an object comprising at least one socket as disclosed in the present application and combined with a plug and/or a block as disclosed in the present application. The assembly forms an object connected by means of the connector formed by the socket and the plug. The object is, for example, a "wearable" object, such as a jacket or a harness or another piece of clothing.

DETAILED DESCRIPTION OF THE INVENTION

The invention will be better understood from the following description of various embodiments and technical features thereof, said embodiments being given as non-limiting examples.

In general, in an embodiment, the connector according to the present invention is similar to the one disclosed in application WO 2017/072620 in that it comprises a socket and a plug, the plug being detachably connected to the socket, as disclosed in this previous application, which is incorporated by reference in the present application.

Figure 1:
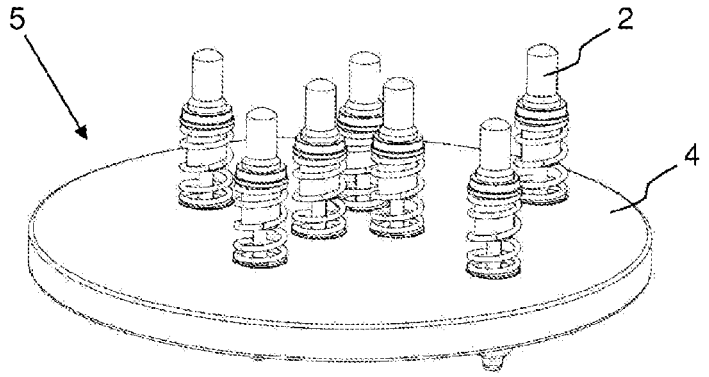
FIG. 1 illustrates a perspective view of a sub-assembly according to an embodiment.

FIG. 1 firstly illustrates a sub-assembly 5 comprising a flexible membrane 4, in which electric contacts 2 are mechanically assembled. Of course, the number of illustrated contacts 2 is an illustrative example and the sub-assembly may comprise at least one single contact 2 or a plurality of contacts 2 (that is less than or more than the number shown in FIG. 1).

The electric contacts 2 preferably have a degree of freedom allowing them to both exert a force on a counter-part positioned opposite the block 1 (that is, for example, a socket 3) and to have independence of movement between each other in order to maintain optimal individual connection properties.

These contacts 2 therefore are mechanically assembled in a flexible membrane 4 so as to form an independent "membrane-contacts" sub-assembly 5, as illustrated in FIG. 1. They may be inserted into the membrane 4, or the membrane may be overmolded on the contacts 2, for example. In one embodiment, there may be a physicochemical contact bond between the membrane 4 and the contacts 2 in order to create the seal.

Figure 2:
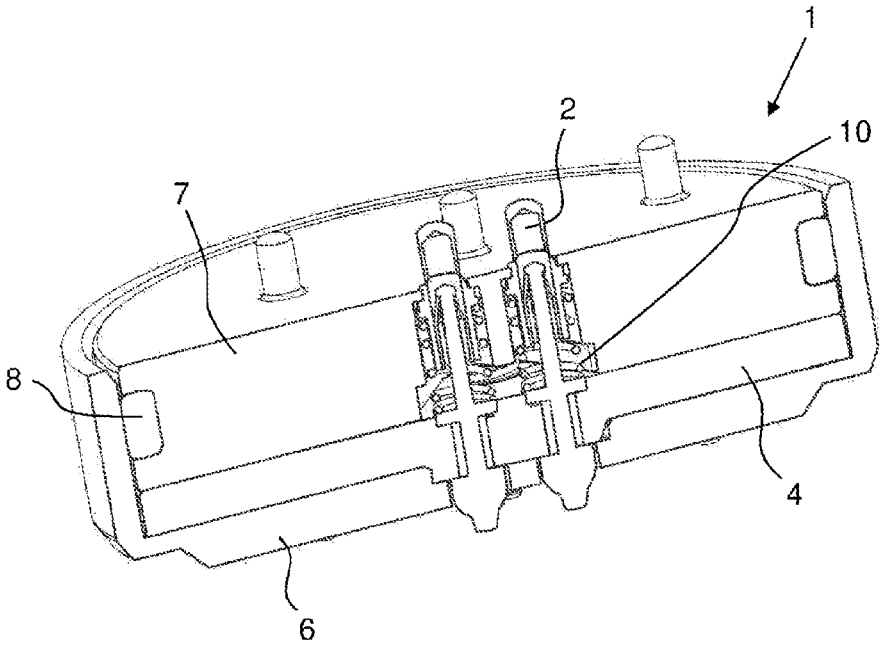
FIG. 2 illustrates a section view of a contact block according to an embodiment.

As illustrated in FIG. 2, the sub-assembly 5 is then encapsulated in a container comprising two insulating parts 6, 7 (for example, manufactured from synthetic materials) exerting, once connected together by any type of means (screwing, clipping, force fitting, gluing, etc.), an axial force on the flexible membrane 4, which is created during the encapsulation. This axial force compresses the membrane and results in the deformation of the flexible membrane 4 in a direction that is essentially perpendicular to that of said force (by this compression between the two parts 6, 7), which allows the seal to be provided between the contacts 2 and the flexible membrane 4, with the membrane, due to its deformation, forcibly conforming to the external shape of the contacts 2. Consequently, a better seal is provided for the system by this force that is applied on the membrane 4 and its deformation in the direction that is essentially perpendicular to that of the compression. More specifically, the membrane deforms by compressing in the direction parallel to that of the axial force and by expanding in the direction perpendicular to that of the axial force, which provides the desired seal around the contacts 25.

The flexible membrane 4 may be produced by any type of means (for example, 3D printing, injection, overmolding, etc.) and from any type of synthetic materials (such as elastomers), so as to withstand chemical agents, for example. The same is the case for the two insulating parts 6, 7, which may, for example, be manufactured from high-performance, thermoplastic or thermohardened materials.

The assembly 1 thus formed is denoted "contact block", see FIG. 2.

The seal between the two assembled insulating parts 6, 7 may be provided by an O-ring type seal 8 or by any other equivalent means (for example, gluing), see FIG. 2.

Figure 3:
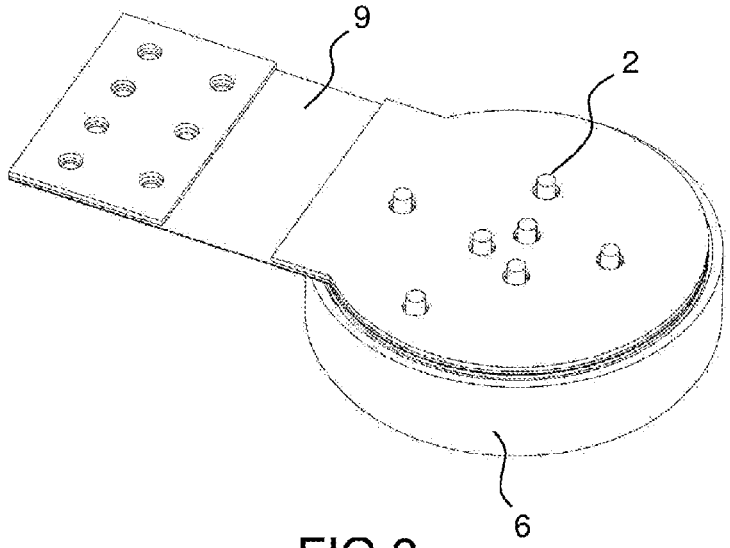
FIG. 3 illustrates a perspective view of a contact block connected to a flexible PCB according to an embodiment.

The contact block 1 may or may not be permanently connected to the external environment by connecting the contacts 2 to wires, to a cable, to a flexible or rigid PCB 9, see FIG. 3, or any other component allowing the desired function to be fulfilled.

Such a contact block 1 according to the invention has the advantage of forming an independent sub-assembly that may be used in any type of connector or connection.

It is also considered to be very easy to clean, with the front face of the block 1 having a highly advantageous geometry in this respect, in particular with respect to the mechanical strength formed by the insulating part 6, which allows the contacts to be protected.

The contacts 2 may be of the "piston contact" type, so that the contact block forms a set of sealed piston contacts, thus resolving the major sealing problem of this type of contact, namely the possibility of seizing due to the ingress of particles or of fluids.

In the event that the contact block integrates "piston contacts", the membrane 4, which acts as an electrical insulator, is directly connected to the movable part of the contact, thus granting it protection against the ingress of liquids or solids, with the junction of the movable part and of the fixed part of the contact being located inside the sealed cavity 10.

Figure 4:
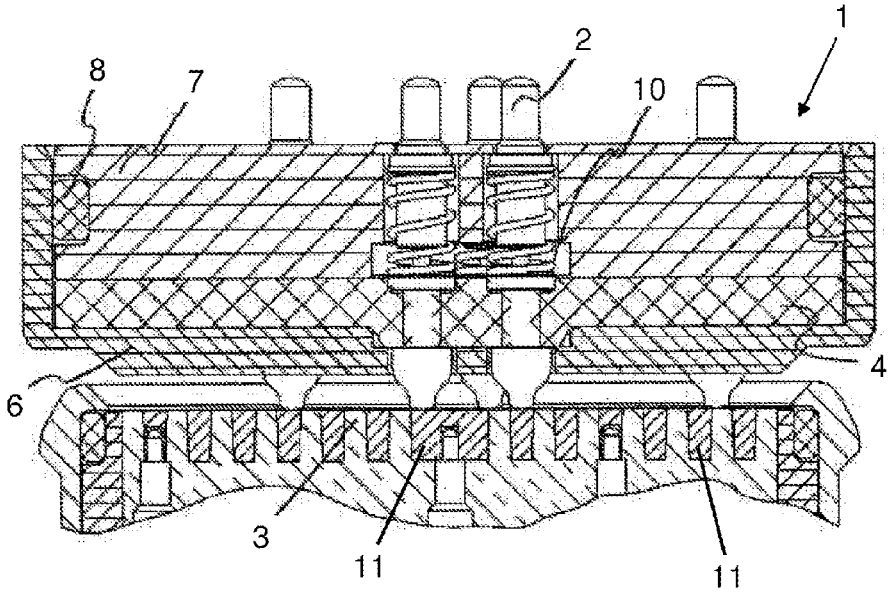
FIG. 4 illustrates a section view of a plug connected to a socket according to an embodiment.
Figure 5:
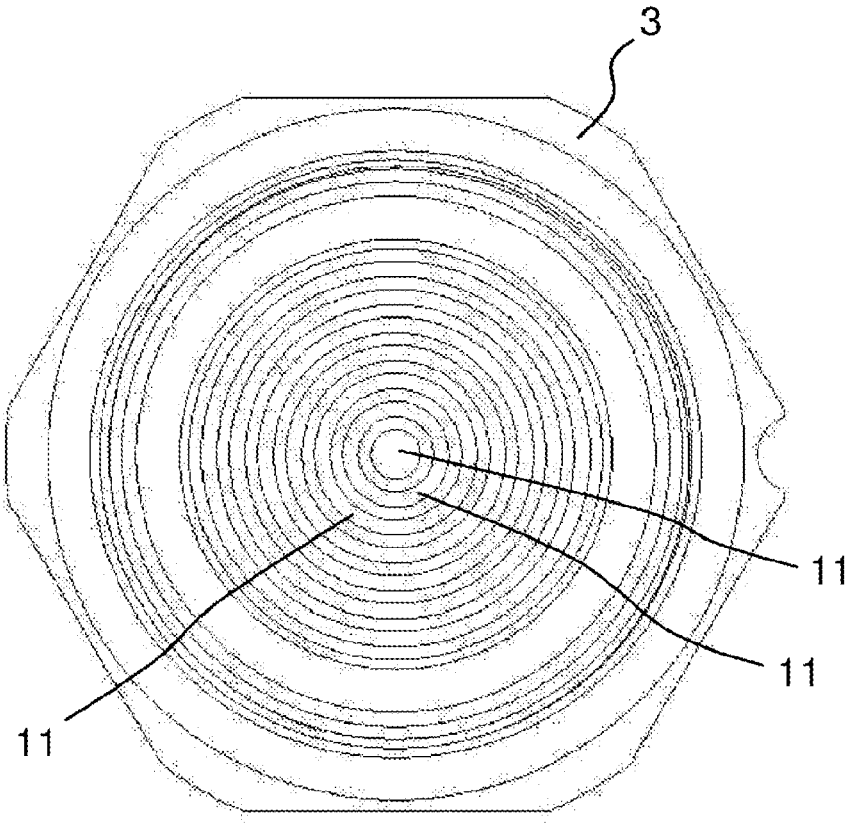
FIG. 5 illustrates a socket according to an embodiment of the present invention.

FIG. 4 illustrates the connection of a block 1 to a socket 3. Typically, the socket 3 and the plug 12 containing the block 1 may be of the type disclosed in WO 2017/072620. By way of an example, FIG. 5 illustrates an example of a top view of such a socket 3, with circular and concentric tracks 11.

Figure 6:
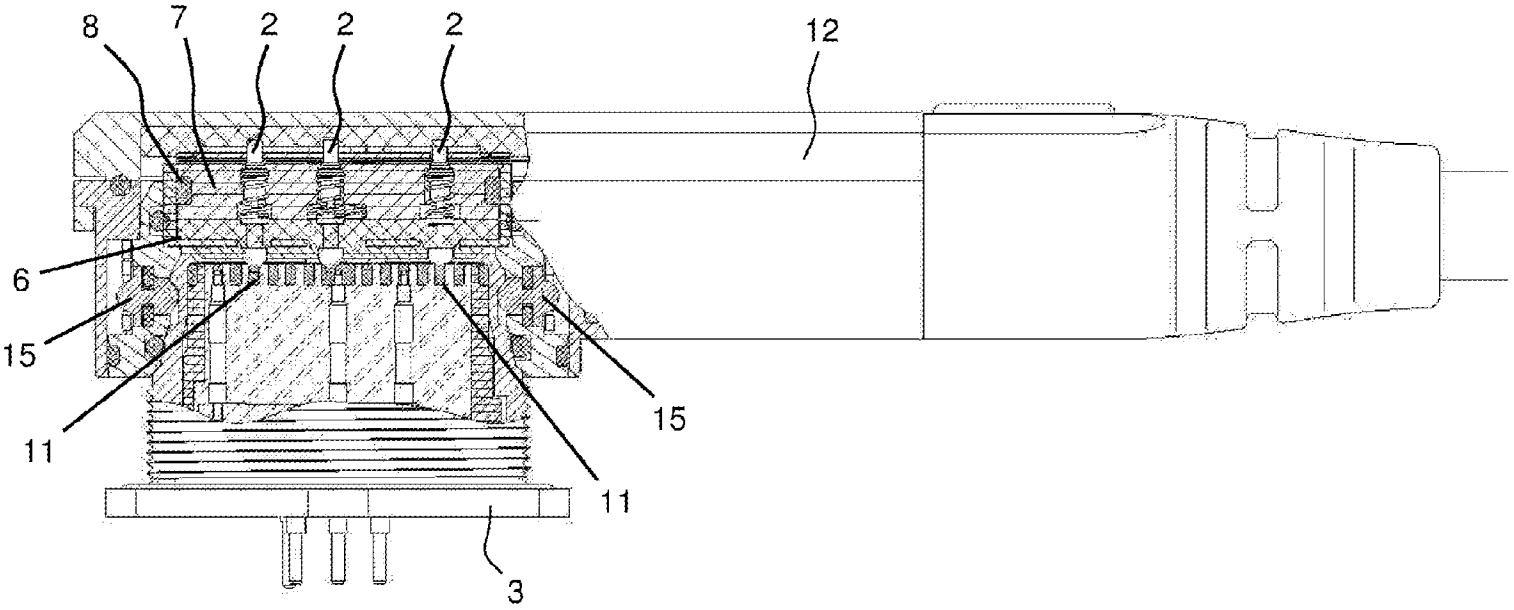
FIG. 6 illustrates a plug and a socket connected according to an embodiment of the present invention.

FIG. 6 illustrates a plug 12 and a socket 3 connected according to the principles of the present invention. The plug 12 particularly comprises a block 1 as disclosed with reference to the preceding figures, with its insulating parts 6 and 7 and the seal 8. The plug 12 also comprises contacts 2, which are in contact with the tracks 11 of the socket, according to the principles of WO 2017/072620.

Naturally, the invention is not limited to this configuration. It also covers connectors comprising at least one contact.

Similarly, the connector according to the invention may assume any dimensions.

The connector according to the invention is unique in that it does not require prior orientation of the plug (for example, a wired element) relative to the socket 3 (for example, an appliance casing element, or on a product such as a garment 13 or other product). This advantage results from the cylindrical/circular geometry of the socket and of its conductive face (see, for example, FIG. 1 of WO 2017/072620). Once connected, the relative rotation between the socket 3 and the plug 12 may be free or blocked by means of a suitable system, for example, of the bi-stable type for the sake of citing a non-limiting example, for example, locking using lateral pressure and unlocking using axial pressure, a system of notches or even a manually activated system. A blockage between the plug 12 and the socket 3 also may be implemented to block the "unplugging" of the plug 12. An example is the system called "push-pull" system. These means also may be implemented in a combined use, i.e. to limit or to block the relative rotation, and also to block unplugging.

Figure 8:
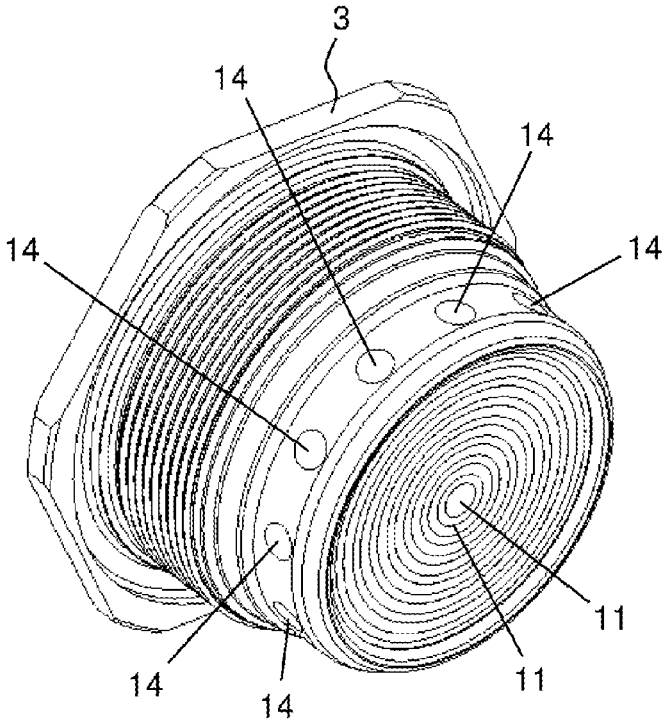
FIG. 8 illustrates an embodiment of a socket with blocking means.

An orientation nevertheless may be provided and limit the possibilities of plugging to a finite number of different angular positions (for example, four separate 90° positions or 12 separate 30° positions), as disclosed in FIG. 2 of WO 2017/072620. FIG. 8 illustrates a socket 3 with tracks 11 and an example of blocking means between the socket 3 and the plug 12. In this example, these means comprise housings 14, in which balls 15 of the plug 12 (see FIG. 6) may be housed in order to block or limit the relative rotation between the plug 12 and the socket 3 and/or to prevent unplugging (for example, below a certain traction force).

Figure 7:
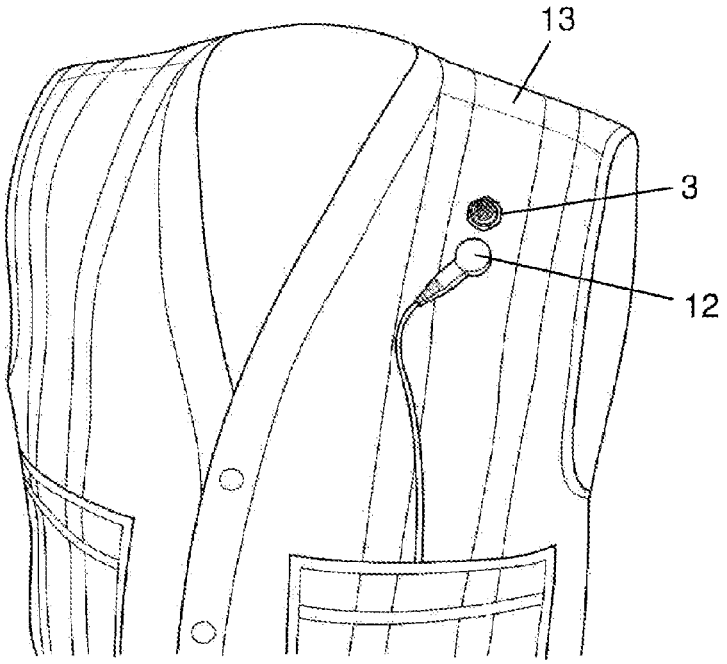
FIG. 7 illustrates an object comprising a connector according to an embodiment of the present invention.

FIG. 7 illustrates an example of the use of a connector according to the present invention. In this non-limiting example, the socket 3 is fixed on a vest 13 and the plug 12 is ready to be connected to the socket 3 in order to assume the configuration of FIG. 6.

Of course, the invention is not limited to the embodiments and examples that are disclosed in the present application by way of a non-limiting illustration. Alternative embodiments are possible within the scope of the conferred and claimed protection, in particular by using equivalent means. The embodiments also may be combined together and technical features of one of the embodiments may be used in another embodiment.

For example, in embodiments, the construction of the plug and of the socket is reversed, i.e. the contacts 2 may be on the socket 3 and the tracks 11 may be on the plug 12. In this case, the construction disclosed in the present application is used but is reversed, namely elements of the plug 12 (particularly illustrated in FIGS. 1 to 4) are placed on/in the socket 3 and elements of the socket 3 (in particular the tracks 33, housings 14, FIG. 7) are placed on/in the plug 12. By way of an example illustrating these embodiments, in FIG. 4, the upper part may form part of the socket and the lower part may form part of the plug. The principles of the present invention as disclosed herein do not change and are correspondingly applicable to these embodiments.

Of course, other alternative embodiments may be contemplated within the scope of the present invention.

The invention claimed is:

1. A connector component comprising:

a plurality of electric contacts, each one of the plurality of electric contacts arranged to electrically connect to one of a plurality of concentrically arranged circular conductive tracks of another connector component; and a flexible membrane having traversing holes, the flexible membrane being traversed by the plurality of electric contacts at respective ones of the traversing holes, wherein side walls of the plurality of electric contacts are in contact with side walls of the corresponding traversing holes of the flexible membrane to provide for a seal between the plurality of electric contacts and the flexible membrane.

2. The connector component according to claim 1, wherein each one of the plurality of electric contacts is configured to provide for a degree of freedom in an axial direction of the respective electric contact, allowing to both exert a force on the another connector component when the connector component is connected to the another connector component, and provide an independence of movement between different electric contacts.

3. The connector component according to claim 1, further comprising:

a locking system configured to permit a rotation of the connector component relative to the another connector component.

4. The connector component according to claim 1, further comprising:

a first and a second insulating part, wherein the flexible membrane is arranged in-between the first insulating part and the second insulating part, compressing the flexible membrane therebetween.

5. The connector component according to claim 1, wherein a physicochemical bond is provided between the flexible membrane and the plurality of electric contacts.

6. The connector component according to claim 1, wherein at least one of the plurality of electric contacts includes a piston-type contact.

7. The connector component according to claim 1, wherein each one of the plurality of electric contacts and the flexible membrane are configured for a free axial movement relative to an axial movement of the other electric contacts.

8. The connector component according to claim 1, further comprising:

a printed circuit board connected to the plurality of electric contacts.

9. The connector component according to claim 1, wherein each one of the plurality of electric contacts includes an electrically conductive pin.

10. The connector component according to claim 4, wherein the plurality of contacts traverse the first insulating part.

11. A connector system including a first connector component and a second connector component, the first and second connector component being connectable to each other, wherein the first connector component includes a plurality of concentrically arranged circular conductive tracks, and wherein the second connector component includes, a plurality of electric contacts, each one of the plurality of electric contacts arranged to electrically connect to one of the plurality of concentrically arranged circular conductive tracks of the first connector component, and a flexible membrane having traversing holes, the flexible membrane being traversed by the plurality of electric contacts at respective ones of the traversing holes, wherein side walls of the plurality of electric contacts are in contact with side walls of the corresponding traversing holes of the flexible membrane to provide for a seal between the plurality of electric contacts and the flexible membrane.

12. The connector system according to claim 11, wherein the first connector component and the second connector component include a locking system that permits a rotation of the first connector component relative to the second connector component when the first and second connector component are connected to each other.

13. The connector system according to claim 11, wherein each one of the plurality of electric contacts is configured to provide for a degree of freedom in an axial direction of the respective electric contact, allowing to both exert a force on the another connector component when the connector component is connected to the another connector component, and provide an independence of movement between different electric contacts.

14. The connector system according to claim 11, further comprising:

a first and a second insulating part, wherein the flexible membrane is arranged in-between the first insulating part and the second insulating part, compressing the flexible membrane therebetween.

15. The connector system according to claim 11, wherein a physicochemical bond is provided between the flexible membrane and the plurality of electric contacts.

16. The connector system according to claim 11, wherein at least one of the plurality of electric contacts includes a piston-type contact.

17. The connector system according to claim 11, wherein each one of the plurality of electric contacts and the flexible membrane are configured for a free axial movement relative to an axial movement of the other electric contacts.

18. The connector system according to claim 11, further comprising:

a printed circuit board connected to the plurality of electric contacts.

19. The connector system according to claim 14, wherein the plurality of contacts traverse the first insulating part.

20. The connector system according to claim 11, wherein each one of the plurality of electric contacts includes an electrically conductive pin.

* * * * *